US005509043A

United States Patent [19]

Van Der Sluis

[11] Patent Number: 5,509,043

[45] Date of Patent: Apr. 16, 1996

[54] ASYMMETRICAL 4-CRYSTAL MONOCHROMATOR

[75] Inventor: Paul Van Der Sluis, Eindhoven, Netherlands

[73] Assignee: U.S. Philips Corporation, New York, N.Y.

[21] Appl. No.: 276,140

[22] Filed: Jul. 18, 1994

[30] Foreign Application Priority Data

Jul. 19, 1993 [BE] Belgium ..... 09300753

[51] Int. Cl.[6] ..... G21K 7/00

[52] U.S. Cl. ..... 378/85; 378/84; 378/70

[58] Field of Search ..... 378/84, 85, 70, 378/71, 76, 78

[56] References Cited

U.S. PATENT DOCUMENTS

| | | | |
|---|---|---|---|
| 4,567,605 | 1/1986 | Bartels | 378/85 |
| 4,821,301 | 4/1989 | Cocks et al. | 378/85 |
| 4,928,294 | 5/1990 | Beard, Jr. et al. | 378/74 |
| 5,287,395 | 2/1994 | Khounsary | 378/70 |

OTHER PUBLICATIONS

"Use of Asymmetric Dynamical Diffraction of X–Rays for Multiple–Crystal Arrangements of the (N1+N2) Setting", Kan Nakayama et al, Z. Naturforsch 28A pp. 632–638 1973.

"Materials Science with SR Using X–Ray Imaging Spatial Resolution/Source Size" M. Kuriyama, Nuclear Instruments and Methods in Physics Research A303 (1991) pp. 503–514.

"Design of High Resolution X–Ray Optical System Using Dynamical Diffraction for Synchrotron Radiation" K. Kohra et al, Nuclear Instruments and Methods 152 (1978) pp. 161–166.

"Dynamical X–Ray Diffraction from a Perfect Crystal Under Grazing Incidence Conditions" H. Hashizume et al, Review of Scientific Instruments (60) 1989 No. 7, Part 2B pp. 2373–2375.

*Primary Examiner*—Constantine Hannaher
*Assistant Examiner*—Don Wong
*Attorney, Agent, or Firm*—Jack D. Slobod

[57] ABSTRACT

An X-ray analysis apparatus comprises a dispersive system of crystals for monochromatizing an incoming beam in a diffractometer or for analyzing an X-ray beam in an X-ray spectrometer. The system of crystals comprises crystals whose crystal lattice planes do not extend parallel to effectively reflective crystal surfaces. As a result, a substantially higher effective radiation intensity can be obtained, for example notably for (220) crystal faces in germanium.

6 Claims, 2 Drawing Sheets

ASYMMETRICAL 4-CRYSTAL MONOCHROMATOR

BACKGROUND OF THE INVENTION

1. Field of the Invention

The invention relates to an X-ray analysis apparatus, comprising an X-ray source, a wavelength-dispersive system of crystals, an object carrier, and an X-ray detection system. The invention also relates to a crystal monochromator and to a crystal analyzer for such an apparatus.

2. Description of the Related Art

An X-ray analysis apparatus of this kind is known from U.S. Pat. No. 4,567,605. So as to achieve notably a high resolution, the apparatus described therein comprises a dispersive element in the form of a 4-crystal monochromator. For specific applications, for example examination of thin layers, be it imperfect as well as epitaxial layers and the like, the comparatively low radiation intensity of the known 4-crystal monochromators may become objectionable. Increasing the radiation intensity by using a high-intensity radiation source makes the apparatus expensive and substantially limits the service life of the radiation source.

SUMMARY OF THE INVENTION

It is an object of the invention to provide an X-ray analysis apparatus enabling operation with a comparatively high radiation intensity. To achieve this, the X-ray analysis apparatus of the kind set forth in accordance with the invention is characterized in that reflective crystal end faces of a dispersive crystal do not extend parallel to diffractive crystal lattice planes in the crystals.

Because the crystal end faces in the monochromator in accordance with the invention do not extend parallel to the crystal lattice planes in the crystals, a larger acceptance angle is realized for an X-ray beam to be monochromatized. (The phenomenon that the crystal end faces used do not extend parallel to the crystal lattice planes is referred to as asymmetry in the context of the present invention). As a result, for analysis in an X-ray diffractometer an effective X-ray beam with a substantially higher radiation intensity can be generated and a higher detection efficiency can be realized in the X-ray spectrometer. Such asymmetry results in a resolution which is less high, but that is not objectionable for different examinations. For many types of examination the high resolution of the known 4-crystal monochromator can be sacrificed for a high intensity then required. The use of the monochromator in accordance with the invention enables faster analysis with a better signal-to-noise milo. In a preferred embodiment reflecting crystal end faces form pan of a 4-crystal monochromator. In the case of an adapted angle between the crystal end faces and the crystal lattice planes, such a monochromator undergoes hardly any or no exterior geometrical modifications relative to the known monochromator, so that it can be included in an X-ray analysis apparatus without requiting complex adaptations. The four crystal end faces preferably enclose the same angle with respect to the relevant crystal lattice planes, but for specific applications deviations therefrom are feasible. The crystals consist of, for example monocrystalline germanium, the diffractive crystal lattice planes being formed by (220) or (440) lattice planes. Because the (220) lattice planes already produce a higher intensity, it is advantageous to use an asymmetrical monochromator in accordance with the invention in the (220) position.

In a further preferred embodiment, the angle between the crystal end faces and the crystal lattice planes amounts to, for example from approximately 15° to 23° for the (220) position. Such a monochromator produces an effective X-ray beam having an intensity which is approximately x times higher than that of the known symmetrical monochromator. Calculations and measurements have demonstrated that x=4 for 15° For such an asymmetry angle the (440) crystal plane mode still acts as the high resolution mode. Calculations have also demonstrated that x =15 for 20.6°.

In order to realize a monochromator which can be fully exchanged, the angle is chosen so that the crystal end faces, measured in the diffraction direction, are large enough to accept the entire incident beam. On the other hand, the value of the angle can also adapted to a desired effective beam intensity for specific examinations.

The monochromator carrier may be constructed so that different measurement modes can be selected by rotation of the crystal pairs, for example an asymmetrical (220) position for high intensity and a (440) position for high resolution. However, upon changing over from one measurement mode to the other in this manner it may occur that no detection of a reflection can be observed. This is because a range of zero intensity is traversed during rotation of the crystal pairs. In the case of a small alignment error (i.e. the angles between the X-my beam and the crystal end faces deviate slightly from the prescribed value), no reflection will occur any more for any angular rotation. Alignment of the experimental arrangement then becomes very difficult. Therefore, in a preferred embodiment the monochromator holder is constructed as a changer system whereby several monochromators can be alternately positioned in the beam path. Because rotation of the crystal pairs is thus avoided, the alignment problem no longer occurs. A monochromator carrier in the form of a changer may also comprise asymmetrical crystals as well as symmetrical crystals with a (220) position as well as a (440) position for the crystals, so that crystal rotation is no longer necessary.

Even though the present description often refers to a monochromator for the sake of clarity, the use of the invention is by no means restricted to what is customarily referred to as a monochromator in an X-ray analysis apparatus. An asymmetrically ground crystal system can also be used as an analyzer in an apparatus of this kind. This is because incoming radiation, now already diffracted from a specimen to be examined, is also discriminated therein in respect of wavelength and/or direction. It may again be advantageous to sacrifice a pan of the resolution for a gain in radiation intensity.

An X-ray monochromator suitable for an X-ray analysis apparatus in accordance with the invention is provided with crystals whose crystal end faces do not extend parallel to diffractive crystal lattice planes. Different crystal lattice planes can be chosen for this purpose; however, crystal lattice planes which already produce a comparatively high effective beam in a symmetrically ground crystal (i.e. a crystal in which the crystal end face extends parallel to the relevant crystal lattice planes), are most suitable for this purpose.

BRIEF DESCRIPTION OF THE DRAWINGS

Some preferred embodiments of the invention will be described in detail hereinafter with reference to the drawing. Therein.

DETAILED DESCRIPTION OF THE PREFERRED EMBODIMENTS

Figure 1:
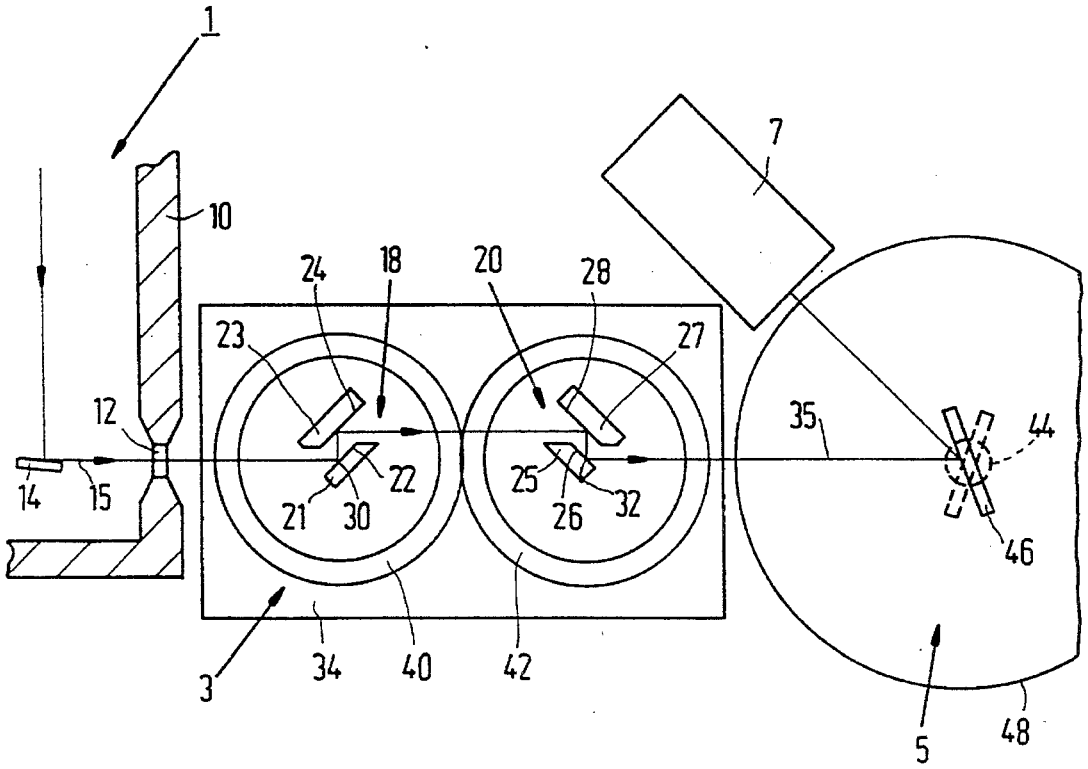
FIG. 1 shows an X-ray diffraction apparatus comprising a 4-crystal monochromator.

FIG. 1 shows an X-ray analysis apparatus with an X-ray source 1, a monochromator 3, a goniometer 5 and a detector 7 which are only diagrammatically shown. The X-ray source 1 comprises an anode 14 which is accommodated in a housing 10 provided with a radiation window 12, which anode consists of, for example copper, chromium, scandium or another customary anode material. An electron beam generates an X-ray beam 15 in the anode.

The monochromator comprises two crystal pairs 18 and 20 with crystals 21, 23, 25 and 27. In the crystal pair 18 crystal end faces 22 and 24 serve as operative crystal faces. Similarly, in the crystal pair 20 crystal end faces 26 and 28 act as operative crystal faces. The first crystal pair can be arranged so as to be rotatable about an axis 30 extending perpendicularly to the plane of drawing, and the second crystal pair can be arranged similarly so as to be rotatable about an axis 32. The end faces 22, 24 and 26, 28 remain mutually parallel in any rotary position. Preferably, the crystals have, for each pair, a U-shape cut from a single monocrystal, the connecting portion of the U being used, for example for mounting the crystals. The inner faces of the limbs of the U then form the operative crystal end faces. Alter cutting and possibly grinding or polishing, a surface layer has been removed from these surfaces, for example by etching, in order to remove material in which stresses may have developed due to mechanical working. The carrier plate 34 for the monochromator has a comparatively rigid construction so that, for example its lower side can be used to support mechanical components, for example for the crystal orientation motions, without risking deformation of the plate. In the present embodiment, the length of one of the crystals of each of the crystal pairs is reduced so that more freedom is obtained in respect of a beam path. The attractive property of the 4-crystal monochromator as regards the angle of aperture for the incoming beam enables the X-ray source, i.e. actually a target spot on the anode 14, to be situated at a minimum distance from the first crystal pair, which minimum distance is determined by the construction of the source. An attractive intensity is thus achieved already for the ultimate analyzing X-ray beam 35.

In the present embodiment the first crystal pair 18 is rotatable about the axis 30 of a shaft on which a first friction wheel 40 which is situated beneath the mounting plate is mounted so as to engage a second friction wheel 42 which is mounted on the shaft with the axis 32 about which the second crystal pair 20 is rotatable. However, the two crystal pairs may alternatively be mutually independently adjustable or the adjustment can be performed by means of a drive motor with, for example programmed settings adapted to the anode material to be used or to specimens to be analyzed. The crystals are preferably made of germanium having operative end faces which extend parallel to the (440) crystal faces of a germanium monocrystal which is relatively free from dislocations. By diffraction from the (440) crystal faces an extremely well monochromatized beam having, for example a relative wavelength width of $2.3\times10^{-5}$, a divergence of, for example 5 arc seconds, and an intensity of up to, for example $3\times10^{4}$ quants per second per $cm^2$ can be formed. Such a sharply defined beam enables measurement of errors in lattice spacings of up to 1 to $10^5$ can be measured and high-precision absolute crystal lattice measurements can also be performed thereby. The monochromatization of the X-my beam is realized in the monochromator by the central two reflections, i.e. the reflections from the crystal faces 24 and 28. The two reflections from the end faces 22 and 26 do influence the beam parameters, but they guide the beam 35 in the desired direction coincident with the prolongation of the incoming beam 15. Wavelength adjustment is achieved by rotating the two crystal pairs in mutually opposite directions; during this motion, therefore, the position of the emergent beam 35 does not change.

An intensity which is, for example 30 times higher can be achieved by utilizing reflections from (220) crystal faces, in which case a larger spread in wavelength and a larger divergence occur.

The monochromator is non-rotatably connected to the goniometer 5 in which a specimen 46 to be analyzed is accommodated in a specimen holder 44. For the detection of radiation emerging from the specimen 46 there is provided a detector 7 which is rotatable along a goniometer circle 48 in known manner. The detector enables measurements to be made throughout a larger angular range and for different orientations of the specimen. For exact determination of the position and possible repositioning of the specimen, the goniometer may include an optical encoder which is not shown in the drawing.

Figure 2A:
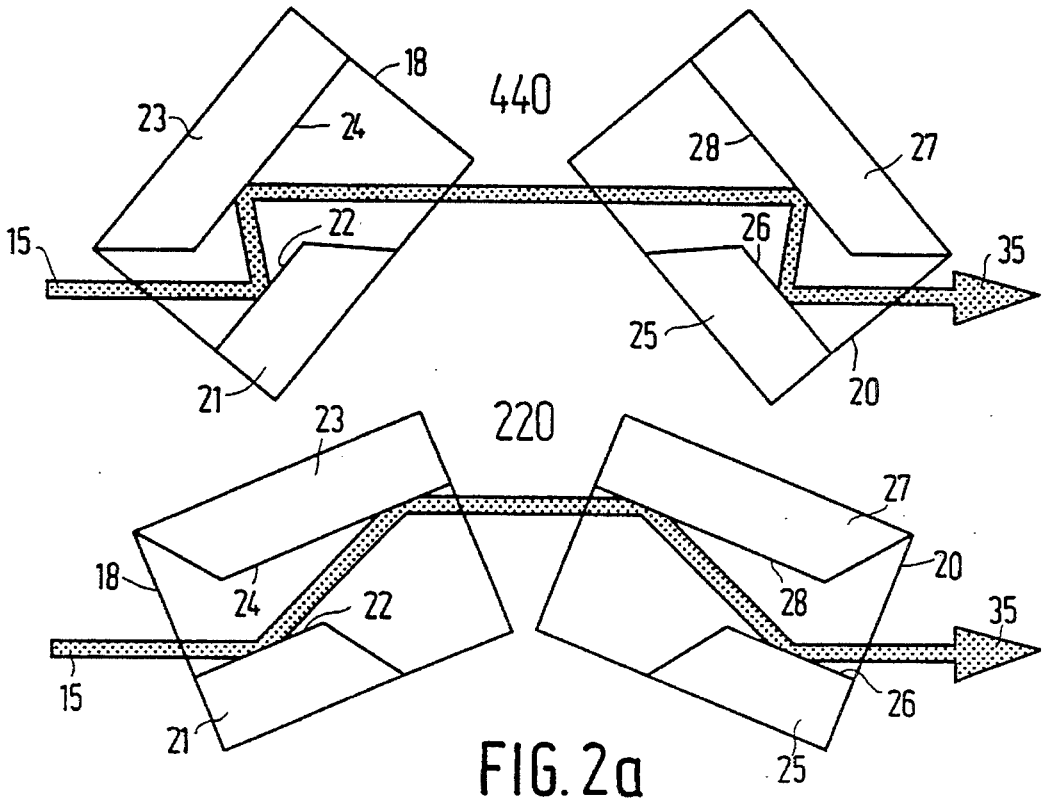
FIG. 2*a–b* shows diagrammatically a symmetrical monochromator and an asymmetrical monochromator.
Figure 2B:
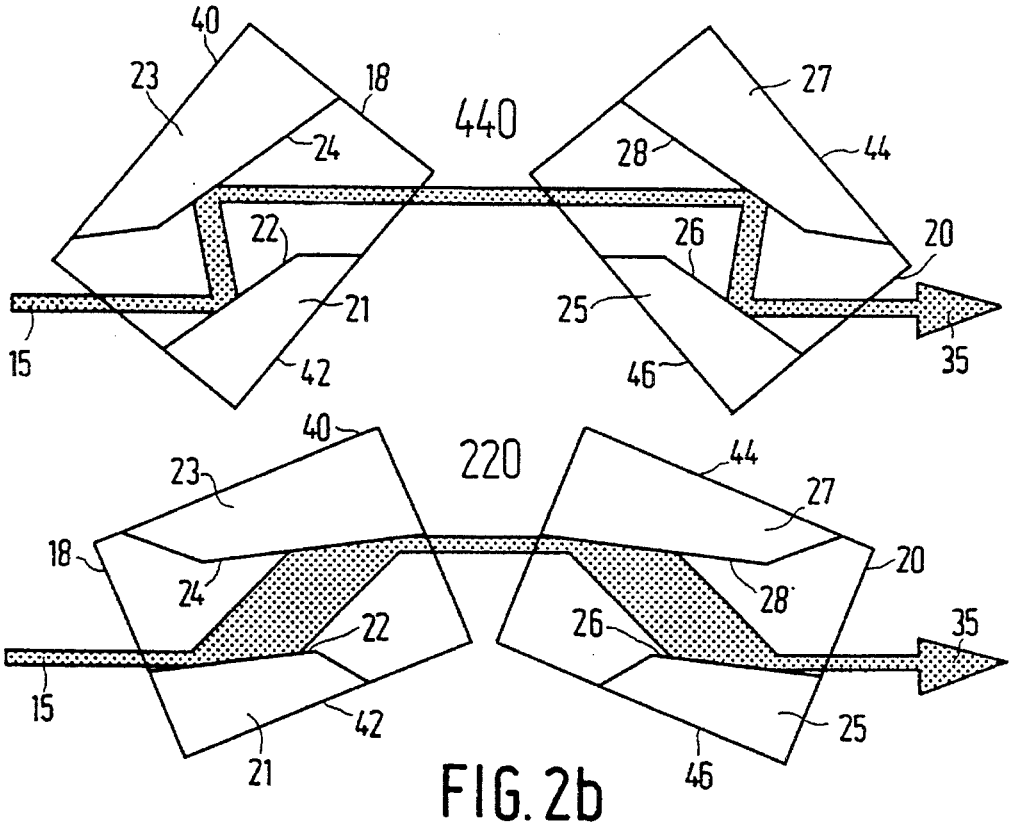

FIG. 2*b* shows an example of an asymmetrical system of crystals in accordance with the invention, compared with a similar symmetrical system as shown in FIG. 2*a*, comprising notably germanium crystals with (440) and (220) lattice planes, respectively. FIG. 2*a* shows the symmetrical system comprising crystals 21, 23, 25 and 27 in which the lattice planes extend parallel to crystal end faces 22, 24, 26 and 28, respectively. FIG. 2*b* shows an asymmetrical crystal system in which the lattice planes are chosen to extend parallel to the outwards facing end faces 40, 42, 44 and 46 of the crystals 23, 21, 27 and 25, respectively; however, the inwards facing crystal end faces 22, 24, 26 and 28 no longer extend parallel to the lattice planes in this Figure. Each crystal exhibits (220) as well as (440) lattice planes; in the upper crystal pairs of the FIGS. 2*a* and 2*b* the (440) lattice planes are used, whereas in the lower crystal pairs of the FIGS. 2*a* and 2*b* the (220) lattice planes are used.

An incoming X-ray beam 15 emerges from the crystal system as a beam 35 which is collinear with the incident beam in all situations. A comparison of the beam diameter of the FIGS. 2*a* and 2*b* already demonstrates that the difference between the symmetrical and the non-symmetrical system is comparatively small for the (440) crystal planes, whereas it is substantial for the (220) crystal planes. The same holds for the resolution.

I claim:

1. An X-ray analysis apparatus adapted to receive an object for analysis, comprising an X-ray source, a system of wavelength-dispersive crystals having operative reflective end faces forming a 4-crystal monochromator, in which the reflective crystal end faces forming the 4-crystal monochromator do not extend parallel to diffractive crystal lattice planes of the crystals, a carrier for receiving the object, and an X-ray detection system, wherein the operative reflective crystal end faces forming the 4-crystal monochromator enclose a selected angle relative to (220) crystal lattice planes in the crystals, which angle between the operative reflective crystal end faces and the crystal lattice planes amount to approximately from 15° to 23°.

2. An X-ray analysis apparatus as claimed in claim 1, wherein the 4-crystal monochromator is made of germanium monocrystals.

3. An X-ray analysis apparatus as claimed in claim 1, wherein the reflective crystal end faces form part of a monochromator means which is constructed to position different monochromators alternately in a beam path of an analyzing X-ray beam.

4. An X-ray analysis apparatus as claimed in claim 3, wherein the monochromator means comprises a monochromator which is oriented in the (440) crystal lattice plane position and a monochromator which is orient in the (220) crystal lattice plane position, at least crystal end faces of the (220) oriented monochromator being asymmetrical.

5. A crystal analyzer comprising an X-ray analysis apparatus as defined in claim 1, wherein said object is a crystal.

6. A crystal X-ray monochromator comprising a system of wavelength-dispersive crystals having end faces forming a 4-crystal monochromator, including a wave-length-dispersive crystal having operative reflective crystal end faces which do not extend parallel to diffractive crystal lattice planes in the crystal, wherein the operative crystal end faces of the monochromator enclosed a selected angle relative to (220) crystal lattice planes in the crystals, which angle between the operative crystal end faces and the said crystal lattice planes amounts to approximately from 15° to 23°.

* * * * *